United States Patent [19]

Combs

[11] Patent Number: 4,938,311

[45] Date of Patent: Jul. 3, 1990

[54] SAWHORSE

[76] Inventor: Linsey L. Combs, Rte. 4, Box 185, Holdenville, Okla. 74848

[21] Appl. No.: 341,423

[22] Filed: Apr. 17, 1989

[51] Int. Cl.[5] ..... B27B 21/00; B25H 1/06

[52] U.S. Cl. ..... 182/155; 182/181; 182/224

[58] Field of Search ..... 182/155, 181–186, 182/224–226

[56] References Cited

U.S. PATENT DOCUMENTS

| | | | |
|---|---|---|---|
| 2,198,956 | 4/1940 | Thielepape | 182/181 |
| 2,436,337 | 2/1948 | Smith | 182/185 |
| 2,854,290 | 9/1958 | Steen | 182/181 |
| 3,613,831 | 10/1971 | Estep | 182/181 |
| 3,666,047 | 5/1972 | Adnerson | 182/185 |
| 4,014,404 | 3/1977 | Jackson | 182/155 |
| 4,226,301 | 10/1980 | McDaniel | 182/155 |
| 4,565,263 | 1/1986 | Southward | 182/184 |

*Primary Examiner*—Reinaldo P. Machado
*Attorney, Agent, or Firm*—Richard F. Bojanowski

[57] ABSTRACT

A kit for use with 2×4 and 2×6 wood pieces to make sawhorses. The legs are constructed for bent metal rods and are secured to brackets or support assemblies that are dimensioned to receive and support the wood piece. A minimal number of nails or screws for securing the wood to the brackets complete the manufacture. In addition, the legs are pivotally secured and may be folded against the wood pieces for storage or transport.

10 Claims, 2 Drawing Sheets

SAWHORSE

FIELD OF THE INVENTION

This invention relates to brackets or support members for use with wooden pieces to make work support units similar to sawhorses and the like. In particular, it relates to support assemblies which employ simple bent metal tubing as legs in combination with simple sheet metal brackets.

There are on the market many brackets and cross-members of the type described almost all of which are useful for load support. However, even though successful, the prior devices suffer from the disadvantage that the metal bracket components or support assemblies are complicated and the support legs, as well as the cross-members, are made solely from wood. The connections require a great many nails or screws to yield a resultant sawhorse that is often heavier than is needed or is desirable. Further, these devices require substantial amounts of space for storage and large numbers cannot be readily transported in small vehicles.

SUMMARY OF THE INVENTION

It is the principal object of this invention to provide a lightweight support assembly having legs made from bent metal tubing or rods and bracket components made essentially of sheet metal wherein a pair of said assemblies are capable of being used in combination with a single wooden cross-member to make a type of light-weight sawhorse work support.

Another object is to provide a pair of support assemblies, whereby, the placement of a wooden cross-member therebetween positions the assemblies for final fastening to complete a sawhorse work support.

A further object is to provide a work support system as described in which connection of the support assemblies to the wood requires minimal fasteners.

A still further object is to provide a support assembly of the type described which includes means for folding the legs against the wooden cross-members for ease of storage and transport.

These, along with other objects and advantages of this invention, will become more readily apparent when construing the specification and drawings accompanying the specification wherein like numerals refer to like parts throughout.

DETAILED DESCRIPTION OF THE INVENTION

The basic structure 10 comprises a support assembly 9 adapted to receive a wooden piece 13.

Figure 1:
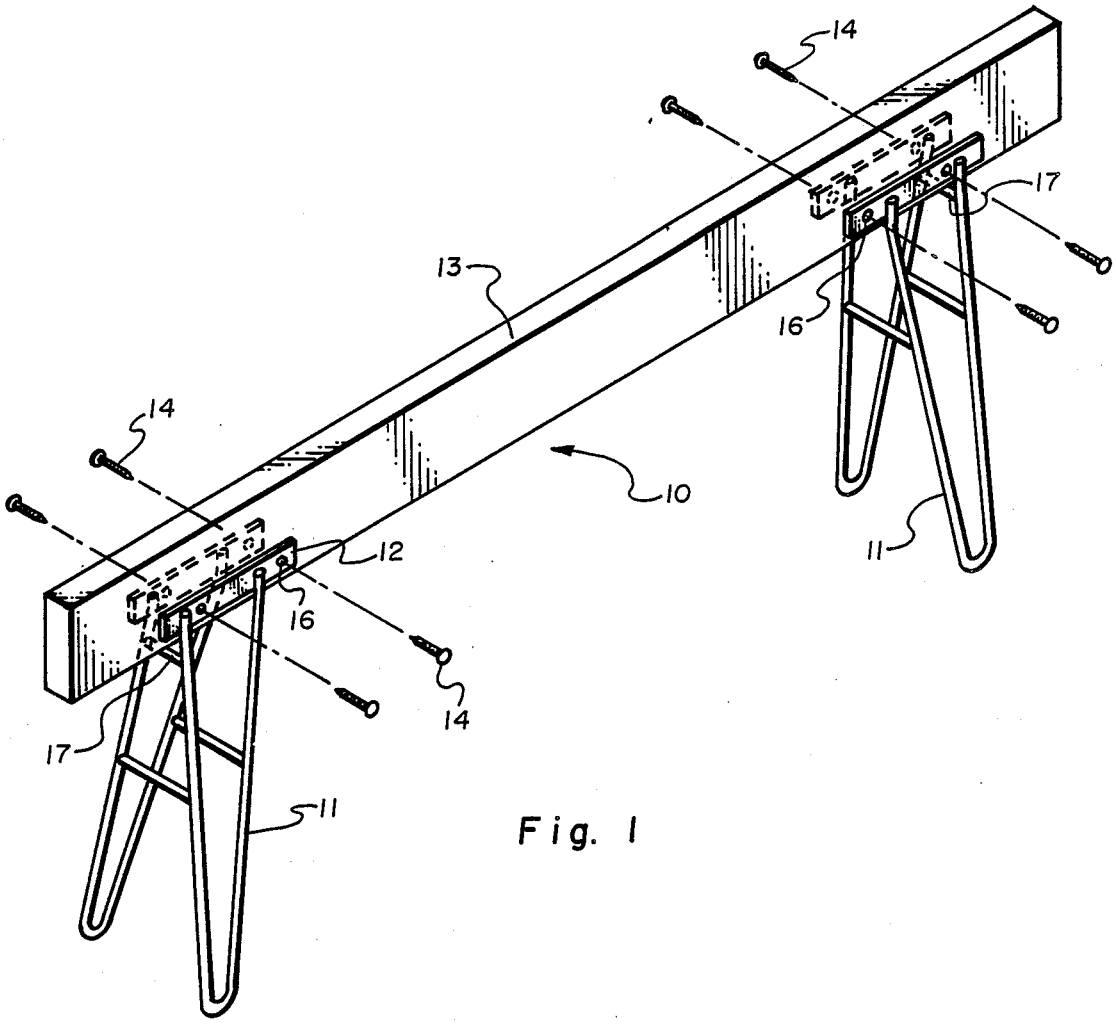
FIG. 1 is a perspective view of a preferred embodiment of the invention.
Figure 2:
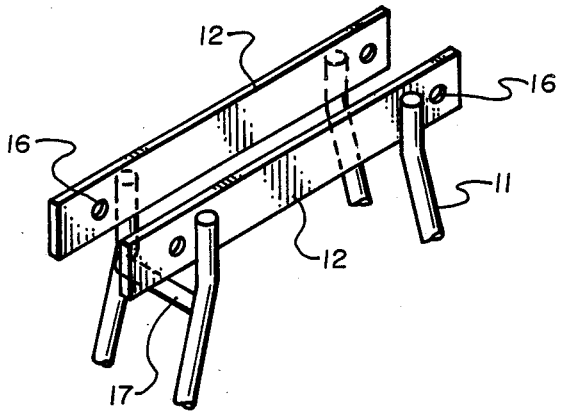
FIG. 2 is a enlarged partial perspective view of the support assembly shown in FIG. 1.

In the embodiment shown in FIGS. 1 and 2 each support assembly 9 comprises a pair of spaced apart side plates 12 adapted to receive therebetween a board 13.

Typically the board is a 2×4 or 2×6 and is fastened to the side plates 12 by nails or screws 14 inserted through pre-drilled holes 16 located on both ends of side plates 12. As shown in FIG. 1, a wood support member consisting of a short support cross-piece 17 is permanently connected between the opposite legs 11 to pass transversely to and beneath the external end of plates 12. The support cross piece in combination with the side plates and legs thus functions as part of a complete support assembly referred to generally by the numeral 9 in FIG. 1. The short support cross-piece forms the bottom member on which the 2×4 rests for positioning during assembly. The legs 11 are preferably formed from bent light-weight tubing such as steel, aluminum or other types of light-weight metal alloy. The materials used should be easily bendable, have relatively high compression values and capable of supporting relatively heavy loads. The legs are formed by bending a hollow metal tube into two substantially "V"-shaped configurations. The upper, or wider, end section of each leg segment is secured to a base plate 12 which in turn is secured to a wooden piece 13. Each of the "V"-shaped piece sections is secured in opposed relation to each other by a short cross piece 17 and a longer cross-piece 18 so that the leg sections are bent outwardly and spread apart to provide surface stability. A second leg is constructed in the same fashion as above described to provide the support assembly 9 of this invention. With the above arrangement, the bent or rounded apex section of each leg rests on the surface while the open or base sections are secured to the side plates. In addition, a second longer cross-piece 18 may be added below and parallel to the short cross-piece to provide leg stability.

For assembly of a sawhorse all that need be done is to set two support assemblies on a flat surface, insert a 2×4 of suitable length so that is rests on the short cross-member 17 then, nail or screw the plates to the 2×4. The fasteners and the short support cross-pieces stabilize and support the 2×4 and any load placed thereon.

To partially disassemble and fold the legs beneath the 2×4 13, the external or outboard fasteners 14 are removed from each of the brackets 12 and the legs are pivotally rotated about the intact internal or inboard fasteners 14 towards the center of the 2×4 13.

Figure 3:
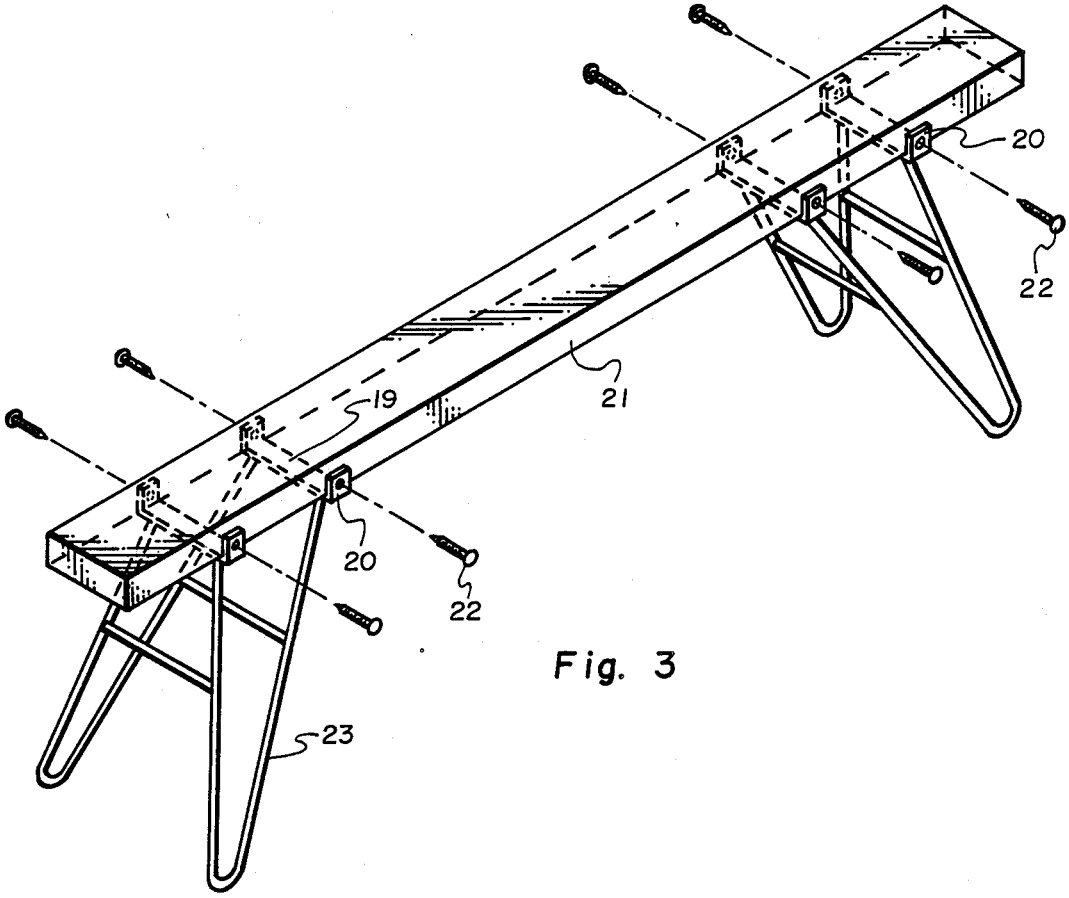
FIG. 3 is a perspective view of a another form of the invention useful in certain situations.
Figure 4:
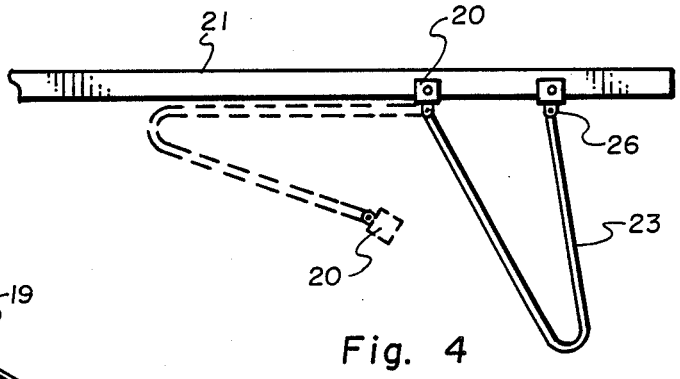
FIG. 4 is a side schematic view of the support assembly shown in FIG. 3.
Figure 5:
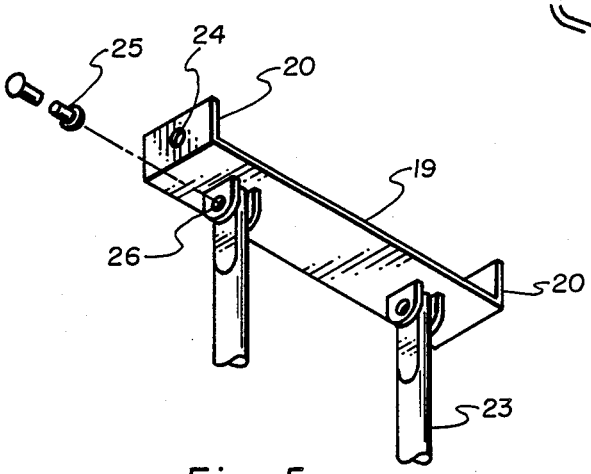
FIG. 5 is a partial perspective view of the underside of one of the support and leg assemblies shown in FIGS. 3 and 4.

The support assembly illustrated in FIGS. 3–5 is basically the same as that shown in FIG. 1 except that instead of a short support cross-piece 17, the bracket is in two pieces each of which comprises a flat bottom support member 19 extending between and connected to the side plates 20. The flat bottom 19 and the support cross piece 17 possess essentially identical functions in both embodiments. A 2×4 or 2×6 board 21 is laid on the support 19 and nails or screws 22 fasten through the holes 24 of the sideplates 20 to the board 21.

In this embodiment, the ends of the bent tubing are flattened and a hole drilled therethrough to provide an aperture. A pair of spaced-apart apertured tabs 26 are secured to the underside of the flat bottom support member 19 near its end sections to receive the flattened end sections of the leg. The apertures are aligned for receiving a bolt or peg 25 about which the legs can pivot when the outboard bolts are removed. If desired, the outboard fasteners 22 of the side plates can be detached from the board and whereupon the legs and side plates can be pivoted about the inboard fasteners to fold against the 2×4 for storage as shown in FIG. 4. In the alternative, the legs may be detached from the brackets by removing the outboard bolts 25 and the legs can pivot about the remaining inboard bolts 25 as previously described. In some cases, and particularly if the manufactures are to be stored over an extended period of time, the former may be preferred as the side plates remain attached to the bent legs 23 and the loss of the removable bolts 25 are less likely.

Although the invention has been described with legs formed from tubing, other metal pieces such as rods or narrow strips of light-weight metal may be used. The choice of material is normally controlled by the manner in which the manufacture is used and the cost, strength etc. of the material available.

I claim:

1. As a manufacture, a kit for use with a pre-dimensional piece of wood to form a load support system comprising a pair of identical support assemblies wherein each support assembly includes at least one wood support member, a pair of spaced apart side plates connected to a pair of interconnected legs formed from bent metal tubing, an inboard and outboard fastening means for securing said side plates to a piece of wood inserted therebetween, said piece of wood being dimensioned such that it rests on said wood support member and means for connecting said wood support member to said interconnected legs.

2. A manufacture according to claim 1 wherein said wood support member comprises a short cross piece member mounted to said interconnected legs a short distance beneath said side plates so that said piece of wood can rest thereon yet provide sufficient wood area to permit fastening of said side plates thereto.

3. A manufacture according to claim 2 wherein said pair of interconnected legs comprise a pair of opposed substantially "V"-shaped leg members, said leg members being spread apart so that its base portion is wider than its apex portion.

4. A manufacture according to claim 3 wherein said spread apart "V"-shaped leg members are interconnected by a stabilizing cross piece positioned in a plane below said short cross piece member and substantially parallel thereto.

5. A manufacture according to claim 4 wherein said outboard fastening means are removable to permit said pair of interconnected legs to pivot about said inboard connecting fastening means when said outboard fastening means are removed.

6. As a manufacture, a kid for use with a pre-dimensional piece of wood to form a load support system comprising a pair of identical support assemblies wherein each support assembly includes at least one wood support member, a pair of spaced apart side plates which includes a flat base member extending therebetween and connected thereto, a pair of interconnected legs formed from bent metal tubing connected to said flat base member, fastening means for securing said side plates to a piece of wood inserted therebetween, said piece of wood being dimensioned such that it rests on said wood support member and means for connecting said wood support member to said interconnected legs.

7. A manufacture according to claim 6 wherein said pair of interconnected legs comprise a pair of substantially "V"-shaped leg members, said leg members being spread apart so that its base portion is wider than its apex portion.

8. A manufacture according to claim 7 wherein said interconnected legs are pivotally fixed to the underside of said flat base member through a pivotal means.

9. A manufacture according to claim 8 wherein said pivotal means includes a pair of spaced apart apertured tabs fixed to the underside of said base members and wherein said legs contain flattened upper end sections having apertues aligned with the apertures in said spaced apart tabs and removable inboard and outboard bolt means passing through said openings to permit said legs to fold beneath said wood by pivoting about said inboard bolt means when said outboard bolt means are removed therefrom.

10. A manufacture according to claim 6 wherein one of said fastening means for connecting said wood support member to said side plates are removable and thereby permits said interconnected legs to fold beneath said wood by pivoting about said inboard fastening means when said outboard fastening means are removed.

* * * * *